United States Patent [19]

Donomoto et al.

[11] Patent Number: 4,573,519

[45] Date of Patent: Mar. 4, 1986

[54] METHOD FOR FORMING METAL BASE COMPOSITE

[75] Inventors: Tadashi Donomoto; Atsuo Tanaka; Shinji Katou, all of Toyota, Japan

[73] Assignee: Toyota Jidosha Kabushiki Kaisha, Toyota, Japan

[21] Appl. No.: 618,680

[22] Filed: Jun. 8, 1984

[30] Foreign Application Priority Data

Jun. 27, 1983 [JP] Japan ..... 58-115597

[51] Int. Cl.[4] ..... B22D 19/14

[52] U.S. Cl. ..... 164/97; 164/120; 164/131; 164/522

[58] Field of Search ..... 164/80, 97, 108, 109, 164/110, 138, 522, 120, 131

[56] References Cited

U.S. PATENT DOCUMENTS 3,853,635 12/1974 Demendi ..... 164/97 X

FOREIGN PATENT DOCUMENTS 1924991 11/1970 Fed. Rep. of Germany ..... 164/522
50-29692 9/1975 Japan ..... 164/138
54-60220 5/1979 Japan ..... 164/522
624694 9/1978 U.S.S.R. ..... 164/522

*Primary Examiner*—Kuang Y. Lin
*Attorney, Agent, or Firm*—Oblon, Fisher, Spivak, McClelland & Maier

[57] ABSTRACT

A method for forming metal base composite use a retainer made of water soluble salt with a high melting point. Molten metal and a reinforcement are compounded in the retainer and then solidified. After solidification the retainer is dissolved away by water.

7 Claims, 3 Drawing Figures

METHOD FOR FORMING METAL BASE COMPOSITE

BACKGROUND OF THE INVENTION

1. Field of the Invention:

This invention relates to an improvement of a method for forming a metal base composite by molten metal infiltration.

A metal base composite is a material in which a reinforcing material in shape as fiber, flake, or powder, is embedded in a matrix metal, to improve such properties of the matrix metal as strength, rigidity and heat resistance.

2. Description of the Prior Art

Conventionally, metal base composites have been manufactured by molten metal infiltration, diffusion bonding or other methods.

In the infiltration method, molten metal is made to contact and impregnate into a preform of a reinforcing material formed in required shape, density and orientation and then solidified to make a metal base composite. The reinforcing material should be preliminarily heated above a certain temperature, in order to prevent solidification of the molten matrix metal before it has made sufficient impregnation into the preform of the reinforcing material.

The density and the orientation of a reinforcing material affect performance of a composite to be fabricated. The shape of the preform of a reinforcing material is determined according to the shape of a final product of the composite. Therefore in order to obtain a metal base composite with desired performance and shape, the shape, density and orientation of the preform of the reinforcing material should be kept constant through the processes of the contact, impregnation and solidification of molten metal.

The shape, density and orientation of the reinforcing material are conventionally retained by (1) preliminary forming the reinforcing material in a mat or a felt form, or (2) constraining and retaining the preform within a casting mold.

However, Method (1) has a disadvantage that the material, density and orientation of the reinforcing material are limited because the reinforcing material is shaped in a mat or a felt form.

Method (2) has a disadvantage that the reinforcing material preliminarily heated may be cooled by contact with a casting mold.

SUMMARY OF THE INVENTION

Efforts are being made to develop another method, in which a suitable retaining tool is used to keep of the density, orientation and shape of the preform of the reinforcing material.

This invention has been completed by finding out a suitable retaining tool with favorable performances.

The first object of the present invention is to provide a method to fabricate a metal base composite with excellent performances in a relatively low cost.

The second object of the present invention is to shorten the time for making a metal base composite and also improve the performances of the composite through use of a newly devised retaining tool.

DETAILED DESCRIPTION OF INVENTION

Figure 1:
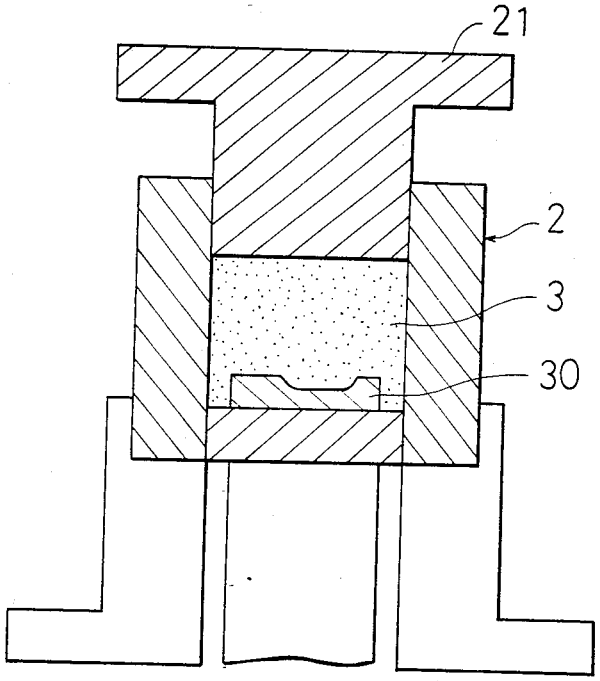
FIG. 1 shows the device for making the retainer used in the first embodiment of the present invention.

The retaining tool is required to have the following performances.

Firstly, the retaining tool must not melt or degrade in the preliminary heating made for facilitating the contact and impregnation of the molten metal against the reinforcing material after the material is retained in the tool.

Secondly, the retaining tool must not react with the molten matrix metal, during the impregnation process. This performance is required since a performance of the produced metal base composite may be degraded if the molten metal should react with the retaining tool.

Thirdly, the retaining tool is desired to have a sufficient heat-insulating effect, to prevent cooling of the molten metal by the casting mold and to prevent solidification caused by the cooling, before the molten metal has been sufficiently impregnated into the reinforcing material.

Fourthly, the retaining tool should be easily removed. In the removal of the tool after the reinforcing material and the metal are integrally formed, the product must not be impaired or contaminated. Also, it is unfavorable in terms of operating efficiency and cost to take a prolonged time in the removal of the tool.

The present invention has been completed by finding out a suitable retaining tool with favorable performances as descrived above.

The present invention relates to a method for manufacturing a metal base composite, comprising a series of steps, the first step wherein a reinforcing material is set in a retaining tool mainly composed of a water soluble salt with a high melting point, the second step wherein the reinforcing material set in the retaining tool is heated above certain temperature and then installed in a mold which has cavity for receiving the retaining tool, the third step wherein molten matrix metal is contacted with and impregnated into the reinforcing material in the mold and then solidified to form a metal base composite with the reinforcing material embedded therein, and the fourth step wherein the retaining tool is dissolved away with water and the metal base composite is taken out.

The retaining tool used in the invention is generally a container whose inner configuration is equal to the external configuration of a composite to be produced. However, the retaining tool may have another shape than a container if it can retain the reinforcing material in the required shape, density and orientation state. A typical retaining tool may be prepared by heating and pressing such water soluble salt as sodium chloride (NaCl), potassium chloride (KCl) and barium chloride ($BaCl_2$), to form a container with a required shape. In order to improve the dimensional accuracy of a retaining tool or facilitate the removal of the tool, $B_2O_3$ or such alkali metal oxide as $Na_2O$, $K_2O$, $Li_2O$ may be added to the water soluble salt. Or, in order to reduce the amount of the salt to be dissolved away with water, a retaining tool may be formed by embedding refractory powder in the water soluble salt.

A reinforcing material is installed in a retaining tool so as to have the required shape, density and orientation in acordance with the shape and performance of a product to be manufactured. A reinforcing material may be powder, flake or fiber including carbon fibers, silicon nitride fibers or ceramic whiskers.

The matrix metal may be aluminium metal, aluminium alloy, copper metal, copper alloy or any other suitable metal or alloy.

A retaining tool in which a reinforcing material is installed is subjected to heating, to prevent insufficient impregnation of the molten matrix metal into the pores of the preform of a reinforcing material due to premature solidification of the metal. Therefore, it is preferable to heat the retaining tool above the melting point of the matrix metal.

The reinforcing material contained in the retaining tool (retainer) is installed in a mold, in which the molten matrix metal is poured to impregnate into the reinforcing material. The above-mentioned mold is a forming mold with a cavity to install the retainer. The mold may be a gravity casting mold, a die casting mold or a melt forging mold. It is preferred to apply pressure to the molten metal during the impregnation process, in order to facilitate the impregnation. The pressure application may be achieved by mechanical means with a plunger or by gas pressurization. The molten metal is solidified in the mold to produce a formed product in which the reinforcing material and the metal are integrated.

Afterwards, the retainer is dissolved away with water and the required metal base composite is obtained. In the case when such additive as $B_2O_3$, $Na_2O$, $Li_2O$ or $K_2O$ is contained in the retainer, the removal may be accelerated by the use of boiling water. And in the case when a water-soluble salt is used as a binder, the disintegration and removal of the retainer may be facilitated because of the reduced amount of salt to be dissolved.

One advantage of the above-mentioned method for manufacturing the metal base composite is reduction of time and cost in the manufacture since the retainer can be removed in a shorter time. Another advantage is improved product quality since the retainer does not react with a molten matrix metal. Another advantage is better dimensional accuracy of the product since the retainer can be in a precise shape. And, another advantage is better performance of the metal base composite since the molten matrix metal is unlikely to be cooled by the mold due to the excellent heat insulation of the retainer and therefore the molten metal can be easily impregnated into the reinforcing material.

DESCRIPTION OF THE PREFERRED EMBODIMENTS

A First Embodiment

Retainer Forming

FIG. 1 shows a device utilized for forming a retainer used in the present embodiment.

Sodium chloride (NaCl), preheated up to 280° C.–320° C., was set in a die 2 shown in FIG. 1, and the salt was pressed at 1000 kg/cm$^2$ with an upper die 21, to form a retainer 3 with a concavity 30 in the shape of a connecting rod.

Installment and Heating of Reinforcing Material $\alpha$-aluminium ($Al_2O_3$) filaments with a 20 $\mu$m diameter installed and suitably oriented in the concavity of the retainer, with a fiber volume percent of 50%. A couple of retainers 3 were fixedly united, with their concavities facing each other and heated to 680° C.

Contact, Impregnation and Solidification

Figure 2:
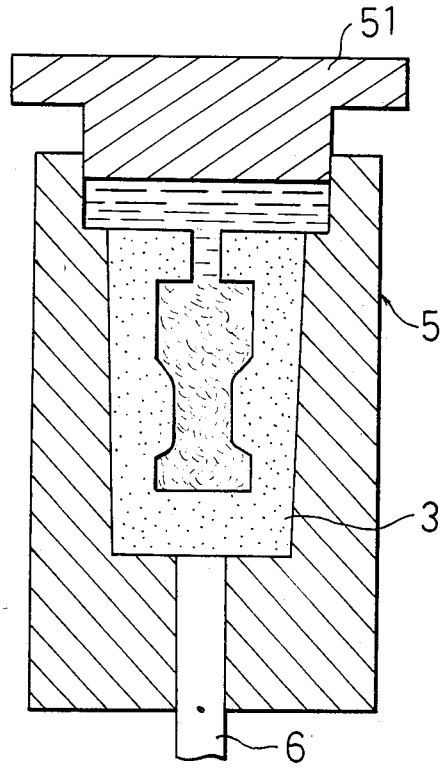
FIG. 2 shows the mold used in the first embodiment, in which the molten matrix metal is contacted with and impregnated into the reinforcing material.

FIG. 2 shows a schematic sectional view of a casting mold, in which a molten matrix metal is contacted with and impregnated into $\alpha$-alumina fibers, reinforcing material.

The preheated sodium chloride retainer 3 containing $\alpha$-alumina fibers was set in the casting mold 5 shown in FIG. 2. Immediately afterwards, a molten aluminum alloy (JIS AC7A) preheated at 750° C. was quickly poured in the mold and a pressure of 1000 kg/cm$^2$ was applied by use of the upper mold 51 and kept until the molten metal was solidified. The interior of the casting mold 5 had been kept at 300° C. until the retainer 3 was installed in the mold.

Removal of Retainer 3

After solidification of the aluminium alloy, the product removed from the casting mold 5 with a knock-out plunger 6, and the extra parts of the product were cut off. Then, the product was dipped in water to dissolve the retainer 3 away, to obtain a metal base composite composed of alumina fibers and aluminium alloy.

The connecting rod made of the metal base composite produced in the above-mentioned method was confirmed to have a higher strength than the conventional steel connecting rod made by forging. Also, the shape density and orientation of the reinforcing material in the composite were found to have retained the shape, density and orientation of the reinforcement before the aluminium alloy was impregnated. The dissolved sodium chloride was found to be reusable for making retainers.

The Second Embodiment

Retainer Forming

Figure 3:
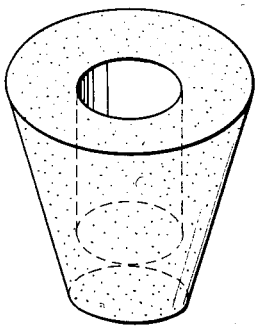
FIG. 3 shows an oblique view of the retainer used in the second embodiment.

FIG. 3 shows an oblique view of the retainer used in the second embodiment. The material of the retainer was a mixture of 90 vol % of barium chloride ($BaCl_2$) and 10 vol % of silicon nitride ($Si_3N_4$). The mixture was heated to 400° C. and then pressed at 1000 kg/cm$^2$ to provide the retainer as shown in FIG. 3.

Installment of reinforcing material

In this embodiment, silicon carbide (SiC) whiskers were used as the reinforcing material. The whisker was installed in the retainer in an amount to provide 30 vol % of the whisker in the composite to be finally obtained. The retainer including the whisker was preheated to 950° C.

Contact, Impregnation and Solidification

The retainer including SiC whiskers, preheated to 950° C., was installed in a casting mold and immediately afterwards a molten copper alloy (JIS high strength brass, HBs.C), heated to 960° C., was quickly poured in the mold and pressed with an upper mold and kept under a pressure of 500 kg/cm$^2$ to complete solidification.

Retainer Removal

After the copper alloy solidified, the metal composite including the SiC whisker was removed from the casting mold with a knock-out plunger. The extra parts of the retainer were cut off and the composite was dipped in water to dissoluve the retainer, to obtain the neat composite consisting of SiC whisker and the copper alloy.

The composite, thus obtained, was confirmed to have high strength and wear resistance as well as good corrosion resistance. The shape, density and orientation of the reinforcing material in the composite were found to have retained the shape, density and orientation before impregnation of the molten copper alloy. The barium chloride was found to be reusable for making retainers.

As apparent from the description so far made, the present invention resides in the method to use a retainer mainly composed of a water soluble salt with a high melting point for constantly retaining the shape, density and orientation of a reinforcing material, in a method to fabricate a metal base composite by impregnation of a molten metal.

As may be understood by the detailed description of the preferred embodiments, the present invention facilitates the removal of a retainer. Therefore, the time for production of a composite can be shortend and no damage of the composite and of the composite quality will occur, which may originate from the removal of the retainer.

Since the retainer in accordance with the present invention has an excellent heat insulation effect, the reinforcing material is difficult to be cooled by a mold and therefore the obtained composite has good performances.

The quality of the composite is also good because the retainer in the present invention does not react with a molten matrix metal.

Also, the dimension accuracy of the composite is good due to excellent dimensional accuracy of the retainer of the present invention.

The water soluble salt used for the retainer can be recycled for reuse.

What is claimed is:

1. A method for forming a metal-base composite, comprising the following steps:

a first step in which a mass of fibrous reinforcing material is taken into a retaining tool having a concavity for receiving the said fibrous reinforcing material and at least one opening, said retaining tool being composed of a water-soluble salt having a high melting point, and said concavity having the same shape as the metal-base composite to be formed;

a second step in which the said retaining tool containing the said fibrous reinforcing material is heated above a certain temperature and then set into a die having a means for receiving the said retaining tool;

a third step in which, through the said opening, a molten matrix metal is made to contact and infiltrate the said fibrous reinforcing material in the said die, and allowing solidification of the said matrix metal to form a composite incorporating the fibrous reinforcing material;

a fourth step in which the said retaining tool containing the said composite is removed from the said die; and a fifth step in which said retaining tool is dissolved away with water.

2. The method of claim 1, wherein pressure is applied to the molten metal during the third step in which the molten metal is made to contact and infiltrate said fibrous reinforcing material.

3. The method of claim 1, wherein the said certain temperature in the second step is the melting point of the said matrix metal.

4. The method of claim 1, wherein the said water-soluble salt is at least one member selected from the group consisting of sodium chloride, potassium chloride and barium chloride.

5. The method of claim 1, wherein the said retaining tool contains at least one member selected from the group consisting of $B_2O_3$, $Na_2O$, $Li_2O$ and $K_2O$.

6. The method of claim 1, wherein said retaining tool is formed by embedding a refractory powder in the said water-soluble salt.

7. The method of claim 1, wherein the said means for receiving the said retaining tool is a cavity in the said die, wherein the said cavity in the said die is the same shape as the said retaining tool.

* * * * *